US010024272B2

(12) United States Patent
Schmidt et al.

(10) Patent No.: US 10,024,272 B2
(45) Date of Patent: Jul. 17, 2018

(54) FUEL-METERING ARRANGEMENT HAVING AN ELECTROMAGNETIC FUEL VALVE

(75) Inventors: Karsten Schmidt, Fellbach (DE); Andreas Hägele, Berglen (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 835 days.

(21) Appl. No.: 12/591,670

(22) Filed: Nov. 27, 2009

(65) Prior Publication Data

US 2010/0126467 A1 May 27, 2010

(30) Foreign Application Priority Data

Nov. 27, 2008 (DE) ..... 10 2008 059 289

(51) Int. Cl.
*F02M 7/12* (2006.01)
*F02M 1/04* (2006.01)
*F02M 17/04* (2006.01)

(52) U.S. Cl.
CPC ..... *F02M 7/12* (2013.01); *F02M 1/04* (2013.01); *F02M 17/04* (2013.01)

(58) Field of Classification Search
CPC ..... F02D 41/0025; F02M 69/00; F02M 1/08; F02M 69/20; F02M 7/12; F02M 1/04; F02M 17/04
USPC ..... 123/437, 438, 434, 435, 436; 261/23.2, 261/36.2, 39.2
See application file for complete search history.

(56) References Cited

U.S. PATENT DOCUMENTS 4,407,244 A * 10/1983 Akagi ..... F02M 7/24 123/438
5,746,191 A * 5/1998 Isobe ..... F02M 25/0809 123/198 D
6,065,453 A * 5/2000 Zych ..... F02M 55/001 123/506

(Continued)

FOREIGN PATENT DOCUMENTS

CN 2089531 U 11/1991
JP 2007-100712 A 4/2007
JP 2007-285208 A 11/2007

OTHER PUBLICATIONS

English translation and first Office action of the Chinese Patent Office dated Jan. 29, 2013 in the corresponding Chinese patent application 200910246608.1.

*Primary Examiner* — Sizo Vilakazi
(74) *Attorney, Agent, or Firm* — Walter Ottesen, P.A.

(57) ABSTRACT

The invention relates to a fuel-metering arrangement for the mixture-forming unit (2) of an internal combustion engine (10) in a portable handheld work apparatus. The mixture-forming unit comprises a fuel store (30), a switchable valve (40) and a fuel channel (20) which opens into an intake region of the engine (10). The valve (40) has an inflow port (41) which is connected to the fuel store (30) and an outflow port (42) which is connected to the fuel channel (20). A fuel column is mechanically moved by the switching of the valve. In order to compensate for this fuel column, the outflow port (42) is connected via a bypass channel (45) to the inflow port (41) and a flow valve (46) is mounted in the bypass channel (45). The flow valve (46) opens in flow direction (49) from the outflow port (42) to the inflow port (41) and blocks in the direction opposite thereto.

13 Claims, 1 Drawing Sheet

(56) References Cited

U.S. PATENT DOCUMENTS

| | | | | |
|---|---|---|---|---|
| 6,478,288 | B1 * | 11/2002 | Duncan | F02M 11/02 261/23.2 |
| 6,932,058 | B2 * | 8/2005 | Nickel | F02M 7/12 123/179.18 |
| 7,126,449 | B2 | 10/2006 | Nickel et al. | |
| 7,159,580 | B2 * | 1/2007 | Shikama | F02M 25/0827 123/518 |
| 7,216,634 | B2 | 5/2007 | Hayasaka et al. | |
| 7,603,983 | B2 * | 10/2009 | Bahner | F02M 1/02 123/179.16 |
| 7,770,561 | B2 | 8/2010 | Kojima et al. | |
| 2001/0010219 | A1 * | 8/2001 | Isobe | F02M 25/08 123/516 |
| 2003/0010319 | A1 * | 1/2003 | Ishimoto | F02M 55/00 123/446 |
| 2004/0231404 | A1 * | 11/2004 | Yamaguchi | F02M 25/0809 73/114.41 |
| 2006/0236983 | A1 | 10/2006 | Douyama et al. | |

* cited by examiner

FUEL-METERING ARRANGEMENT HAVING AN ELECTROMAGNETIC FUEL VALVE

CROSS REFERENCE TO RELATED APPLICATION

This application claims priority of German patent application no. 10 2008 059 289.7, filed Nov. 27, 2008, the entire content of which is incorporated herein by reference.

FIELD OF THE INVENTION

The invention relates to a fuel-metering arrangement for the mixture formation unit of an internal combustion engine including an internal combustion engine in a portable hand-held work apparatus such as a motor-driven chain saw, cutoff machine, blower apparatus, brushcutter or the like.

BACKGROUND OF THE INVENTION

U.S. Pat. No. 7,126,449 discloses an electromagnetic fuel valve which functions to meter the fuel quantity to be fed to a mixture-forming unit. The valve member is formed by a valve plate which lies transversely to the flow direction of the fuel. A column of fuel is moved mechanically by a movement of the valve plate whereby the accuracy of a fuel quantity can be affected with this fuel quantity being metered by the valve.

Basically, a liquid column is mechanically moved in each valve with a mechanically moved valve member in the switching operation which, for larger metered quantities, is insignificant in relationship to the metered quantity. However, metering inaccuracies can occur with respect to small quantities in relationship to the metered quantity. This is especially the case with pulsewidth-modulated drive signals with which the valve is driven at a fixed frequency.

SUMMARY OF THE INVENTION

It is an object of the invention to configure a fuel-metering system having a fuel-metering valve so that even the smallest fuel quantity can be metered with precision.

The fuel-metering arrangement of the invention is for a mixture-forming unit of an internal combustion engine having an intake region. The fuel-metering arrangement includes: a fuel store; a switchable valve having an inflow port connected to the fuel store; a fuel channel opening into the intake region of the internal combustion engine; the switchable valve having an outflow port connected to the fuel channel; a bypass channel connecting the outflow port to the inflow port and defining a flow direction from the outflow port to the inflow port; and, a flow valve mounted in the bypass channel for opening in the flow direction and closing in a direction opposite to the flow direction.

The outflow port of the valve is connected to the inflow port via a bypass channel. A flow valve is mounted in the bypass channel which opens in flow direction from the outflow port to the inflow port and blocks in the opposite direction. The flow valve is configured similar to a check valve without a valve spring and therefore opens essentially pressureless. The valve member of the flow valve is therefore essentially force free and is opened or closed in correspondence to the volume flow in the bypass channel.

Because of the bypass channel, the mechanically moved fuel column can flow off via the then opening flow valve and is not pressed via the inflow port into the fuel-metering unit. In this way, the metering of even the smallest fuel quantities is possible with precision.

A throttle is formed in the bypass which can be configured by the passthrough cross section of the bypass channel. It can be practical to configure the throttle between the outflow port and the flow valve.

The throttle of the fuel channel, which is connected to the outflow port, is approximately the same as the throttle of the bypass channel and is preferably slightly larger. In this way, the situation is achieved that the mechanically moved fuel column flows off via the bypass channel because of the lower flow resistance therein without the occurrence of an effect on the fuel-metering arrangement.

The fuel-metering arrangement according to the invention is especially provided for small-volume engines, preferably two-stroke engines having a stroke volume of approximately 10 to 200 $cm^3$ and especially approximately 22 to 122 $cm^3$. The fuel quantity, which is metered by the valve, lies in the range of 60 to 300 g/h.

BRIEF DESCRIPTION OF THE DRAWINGS

The invention will now be described with reference to the drawings wherein.

DESCRIPTION OF THE PREFERRED EMBODIMENTS OF THE INVENTION

Figures 1, 2:
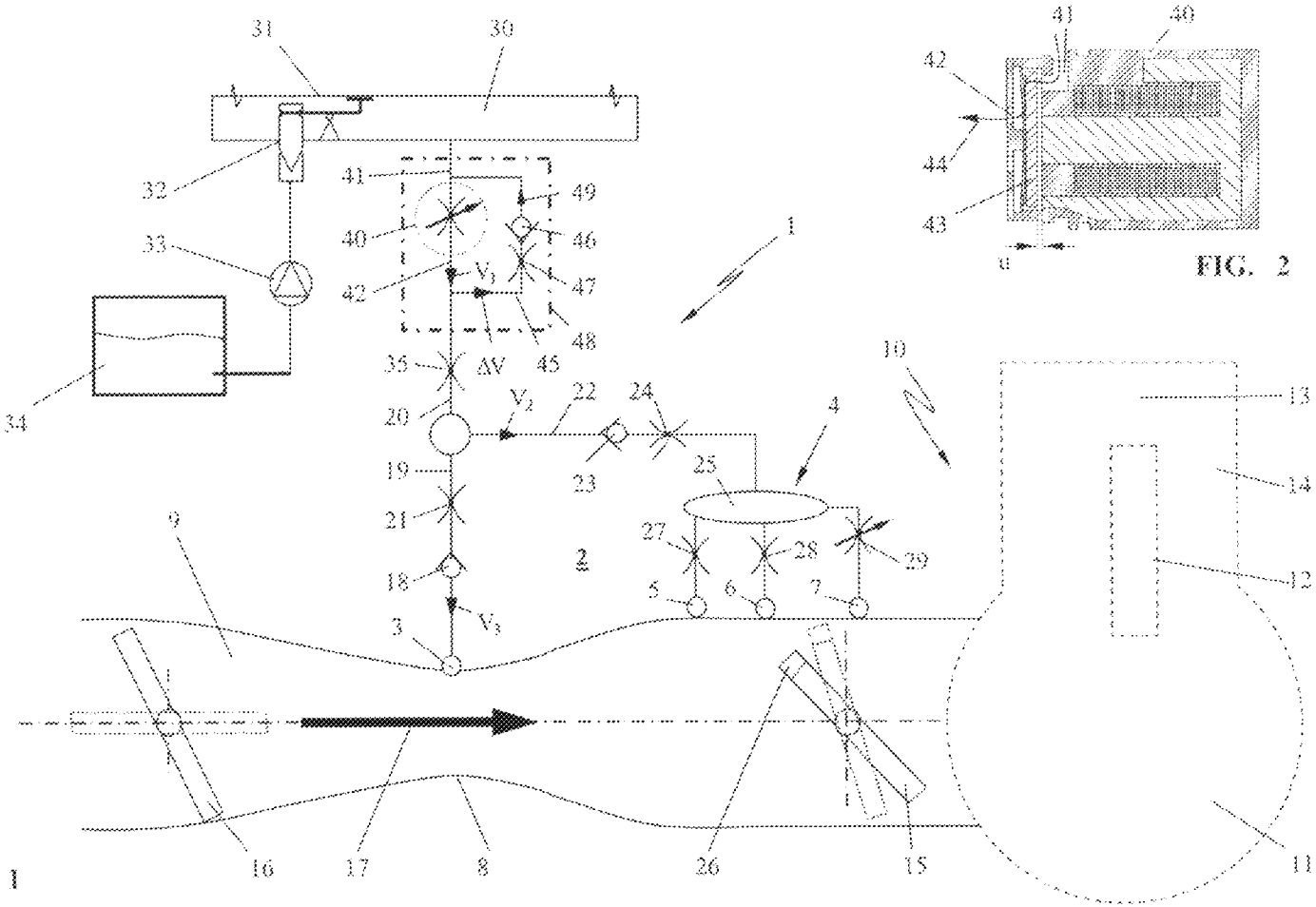
FIG. 1 is a schematic of a fuel-metering arrangement of the invention for an internal combustion engine; and, FIG. 2 is a section view taken through an electromagnetic fuel valve.

In FIG. 1, a fuel-metering arrangement 1 which supplies fuel to a mixture-forming unit 2 is shown. In the embodiment shown, the mixture-forming unit comprises a main nozzle 3 as well as an idle-nozzle system 4 including an idle nozzle 7 and two part-load nozzles 5 and 6. The nozzles 3, 5, 6 and 7 open into an intake channel 9 in the region of a venturi 8. The intake channel 9 leads the prepared air/fuel mixture to an internal combustion engine 10.

In the embodiment shown, the engine 10 is a two-stroke engine wherein the intake channel 9 opens into the crankcase 11. The mixture is supplied from the crankcase 11 via transfer channels 12 to a combustion chamber 13 of a cylinder 14. The configuration and operation of the two-stroke engine are of general knowledge.

In the intake channel 9, a throttle flap 15 as well as a choke flap 16 are arranged with the choke flap 16 being mounted upstream of the throttle flap 15 and the flaps influence the underpressure in the intake channel 9 in dependence upon their rotational position in the intake channel 9. The choke flap 16 lies upstream viewed in the flow direction 17 of the combustion air, that is, ahead of the venturi 8; whereas, the throttle flap 15 is arranged downstream of the venturi 8, that is, after the venturi.

The main nozzle 3 opens approximately at the center in the venturi 8 and is connected to the fuel-metering main fuel channel 20 via a flow valve 18 opening in flow direction toward the venturi. Because of the channel cross section, the main nozzle path 19 has a throttling effect which is indicated by the throttle 21.

The idle nozzle path 22 likewise branches off from the main fuel channel 20. A flow valve 23, which opens without pressure, is mounted in the idle nozzle path and this flow valve opens in flow direction from the main fuel channel 20 to the nozzles 5, 6 and 7. The channel cross section of the idle nozzle path 22 has a throttle effect which is indicated by the throttle 24.

The idle nozzle path opens into an idle chamber 25 from which the nozzles 5, 6 and 7 are fed.

The idle nozzle 7 lies downstream of the throttle flap 15 when the throttle flap is in the idle position shown in phantom outline in FIG. 1. The combustion air, which is necessary for idle, flows in through an opening 26 in the throttle flap. The part-load nozzles 5 and 6 lie at a spacing from each other upstream of the throttle flap 15. The part-load nozzles 5 and 6 are connected to the idle chamber 25 via fixed throttles 27 and 28, respectively. The path of the idle nozzle 7 is provided with an adjustable throttle 29 in order to adjust the fuel quantity needed at idle.

The main fuel channel 20 is fed from a fuel store 30 which, in the embodiment shown, is configured as a control chamber of, for example, a membrane carburetor. The membrane 31 of the control chamber controls a feed valve 32 via which fuel is supplied from a fuel tank 34 by means of a fuel pump 33 driven by the changing crankcase pressure. The feed valve 32 is controlled by the membrane 31 of the control chamber 30 so that approximately constant operating pressure can be maintained in the fuel store 30. The main fuel channel 20 branches off from the fuel store 30 and feeds the main nozzle 3 and the idle nozzle system 4.

A switching valve 40, especially an electromagnetic switching valve, is mounted in the main fuel channel 20. The fuel flow in the main channel 20 is controllable via the switching valve 40. For metering a desired fuel quantity, the valve 40 is opened and closed in rapid sequence, that is, the valve 40 is clocked whereby an average fuel flow is adjusted. When the open phases are longer than the closing phases, then a large fuel quantity is permitted and, if the closed phases are longer than the open phases, a low fuel quantity is adjusted. A desired fuel flow in the fuel channel 20 is adjusted by varying the opening and closing times and, in this way, a desired fuel quantity is metered. This type of digital drive of the valve 40 takes place, preferably, at a fixed frequency so that the fuel quantity can be adjusted by controlling the pulsewidth (pulsewidth modulation of switching valve 40).

The electromagnetic valve 40 has a fuel inflow port 41 and a fuel outflow port 42. In the embodiment shown, the valve member 43, which switches the throughflow, is a valve plate which moves in flow direction or opposite to the flow direction 44 of the fuel for closing or opening the valve. Because of the valve stroke (u), the valve member 43 displaces the fuel column which loads the same with a switch movement in flow direction 44 of the fuel or opposite thereto. This can lead to the situation that, when opening the valve 40, fuel is pushed mechanically into the fuel channel 20 and therefore into the main nozzle system and/or idle nozzle system whereby irregularities in the mixture formation can occur.

As shown in FIG. 1, the outflow port 42 is connected to the inflow port 41 via a bypass channel 45 and a flow valve 46. The bypass channel 45 thereby bypasses the valve 40. The flow valve 46 opens essentially pressure free in flow direction 49 of the difference quantity ΔV from the outflow port 42 to the inflow port 41 and closes in the opposite direction. The valve member of the flow valve 46 is entrained by the fuel flow. Should a fuel flow adjust opposite to flow direction 49, the valve 46 closes and, when a fuel flow adjusts in flow direction 49, the valve opens without pressure, that is, the opening pressure of the valve 46 is approximately zero. The flow valve 46 thus is a valve preventing a backflow opposite flow direction 49. The channel, which forms the bypass 45, has a throttle effect which is shown by the throttle 47. The throttle 47 lies between the outflow port 42 of the switching valve 40 and the pressureless opening flow valve 46.

As shown in phantom outline, the valve 40 together with the return-conducting bypass channel 45 is, conjointly, preferably a component 48.

The operation of the system shown in FIG. 1 will now be described.

The engine is at idle when the choke flap 16 is in the opened position as shown in phantom outline and the throttle flap 15 is in the closed position shown in phantom outline. The metering of fuel at idle takes place by clocking the switching valve 40. The fuel quantity, which is supplied at idle, is low. In the embodiment, a fuel flow in the volume range of approximately 60 to 300 g/h is assumed.

In the intake channel of the engine 10, which is configured as a two-stroke engine, a corresponding underpressure is present at the idle nozzle 7 so that the idle system 4 draws a corresponding fuel quantity from the main fuel channel 20. This fuel quantity is metered by the valve 40. The fuel quantity $V_2$, which flows off via the idle nozzle path 22, is very low at idle. For this reason, only a slight underpressure is present at the throttle 35 formed by the channel cross section of the main fuel channel 20. In the opening operation of the switching valve 40, a fuel quantity $V_1$ is moved by the mechanically moved fuel column in addition to the adjusted delivered quantity with $V_1>V_2$. This surge-like increasing fuel quantity $V_1$ cannot flow out via the throttle 35 because the suction underpressure of the idle fuel system 4 is only low at throttle 35. The throttle 35 is dynamically slightly greater than the throttle 47 of the bypass channel 45 so that the fuel surge ΔV, which is caused by the switching operation, flows off or is displaced to the inflow port 41 via the flow valve 46 opening in the flow direction. The throttling action of the throttle 47 (channel cross section of the bypass channel 45) and the throttle action of the throttle 35 (channel cross section of the main fuel channel 20) are designed to be approximately equal; preferably, the throttle 35 of the fuel channel 20 has, statically, a slightly greater value than the throttle 47 of the bypass channel 45. The throttle action at the throttle 35 can become less than the throttle 47 of the bypass channel 45 when considering the dynamic underpressure at the throttle 35 of the main fuel channel.

When the throttle flap 15 as well as the choke flap 16 are completely open, then the fuel quantity, which is needed for full-load case of the engine 10, passes via the main nozzle 3 whereby a correspondingly high suction underpressure is present in the main fuel channel 20. Because of the higher underpressure, the effect of the throttle 35 lowers. The throttling action of the throttle 35 is then composed of the geometric dimensions and the suction underpressure of the mixture-forming unit 2 acting at the throttle 35. The fuel column, which is moved mechanically by valve 40, is drawn off by suction via the main nozzle path 19.

The fuel quantity $V_1$, which is metered in the full-load case, is approximately equal to the outflowing fuel quantities $V_2$ and $V_3$. The total metered fuel quantity $V_1$ is drawn by suction into the intake channel 9. In the switching operation of the valve 40, the surge quantity ΔV of the valve 40 is low relative to the outflowing quantities $V_2$ and $V_3$. The high suction underpressure and the large fuel flow through the throttle 35 causes the dynamic throttle action of the throttle 35 to be considerably less than the throttle action of the throttle 47 in the bypass channel. For this reason, the surge quantity ΔV in the mixture-forming unit 2 is drawn off by suction. A fuel flow opposite the arrow direction 49 in the bypass channel 45 cannot occur notwithstanding the high suction underpressure in the main fuel channel 20 because the flow valve 46 closes.

In idle, the influence of the mechanically moved fuel column on the mixture-forming unit 2 is minimized and in the optimal case made irrelevant by the feature of the bypass channel 45 of the invention with the flow valve 46 operating as a check valve. In the full-load case, the flow valve 46 closes and the bypass channel 45 is essentially without effect.

An electromagnetic fuel valve 40 is shown in FIG. 2 and the configuration thereof is described in detail in U.S. Pat. No. 7,126,449 which is incorporated herein by reference.

It is understood that the foregoing description is that of the preferred embodiments of the invention and that various changes and modifications may be made thereto without departing from the spirit and scope of the invention as defined in the appended claims.

What is claimed is:

1. A fuel-metering arrangement for a mixture-forming unit of an internal combustion engine having an intake region, the fuel-metering arrangement comprising:

a fuel store configured to contain liquid fuel;

a switchable fuel valve having a liquid fuel inflow port connected to said fuel store;

a fuel channel opening into said intake region of said internal combustion engine and supplying liquid fuel in a first flow direction;

said switchable fuel valve having a liquid fuel outflow port connected to said fuel channel;

said liquid fuel inflow port being configured to have liquid fuel flow in thereto;

said liquid fuel outflow port being configured to have liquid fuel flow out therefrom;

a bypass channel connecting said liquid fuel outflow port to said liquid fuel inflow port and defining a second flow direction of the liquid fuel from said liquid fuel outflow port to said liquid fuel inflow port;

a flow valve mounted in said bypass channel and configured as a check valve for opening in said second flow direction from said outflow port to said inflow port and closing in said first flow direction;

said switchable fuel valve having a movable valve member configured to be surrounded by liquid fuel, perform a valve stroke (u), and be moved in or opposite to said first flow direction so as to open or close said switchable fuel valve;

said valve member being configured to move therewith a fuel column of liquid fuel, which bears on said valve member, with each movement in or opposite to said first flow direction of liquid fuel;

said check valve being configured to open and close in correspondence to a volume flow in said bypass channel so as to permit said fuel column, which is mechanically moved by said valve member, to flow off into said fuel store via said check valve in said bypass channel when said check valve opens;

a throttle configured in said bypass channel;

said throttle being disposed between said outflow port and said check valve;

said throttle being a first throttle having a first throttle resistance;

a second throttle configured in said fuel channel; and, said second throttle having a second throttle resistance approximately equal to or slightly greater than said first throttle resistance.

2. The fuel-metering arrangement of claim 1, wherein said first and second throttle resistances are determined by the configuration of the respective passthrough cross sections of said bypass channel and said fuel channel.

3. The fuel-metering arrangement of claim 2, wherein said internal combustion engine is a small-volume engine.

4. The fuel-metering arrangement of claim 3, wherein said small-volume engine is a two-stroke engine having a stroke volume of approximately 10 to 200 $cm^3$.

5. The fuel-metering arrangement of claim 4, wherein said two-stroke engine has a stroke volume of approximately 22 to 122 $cm^3$.

6. The fuel-metering arrangement of claim 1, wherein the fuel quantity metered by said switchable fuel valve is approximately 60 to 300 g/h.

7. The fuel-metering arrangement of claim 1, wherein said intake region of said internal combustion engine includes an intake channel defining a venturi; and, said fuel channel opens into said intake channel in the region of said venturi.

8. The fuel-metering arrangement of claim 7, wherein said fuel channel branches into a main nozzle path and an idle nozzle path.

9. The fuel-metering arrangement of claim 8, wherein said intake region defines a flow direction of the combustion air drawn into said engine and said mixture-forming unit includes a main nozzle in said venturi and a throttle flap; and, said main nozzle path opens into said venturi via said main nozzle and said idle nozzle path opens in said flow direction of the combustion air in the region of said throttle flap.

10. The fuel-metering arrangement of claim 1, wherein:

said valve member of said electromagnetically switchable fuel valve is a movable valve plate placed in said fuel channel between said fuel store and said mixture-forming unit;

fuel passes through said switchable valve in a flow direction; and, said valve plate carries out an opening movement from a closed state into an open state in said flow direction of said fuel through said switchable valve.

11. The fuel-metering arrangement of claim 10, wherein said switchable fuel valve, said bypass channel and said flow valve are arranged in a common component.

12. The fuel-metering arrangement of claim 1, wherein said fuel in said fuel store is a liquid fuel.

13. The fuel-metering arrangement of claim 10, wherein said fuel valve defines a longitudinal axis; and, said valve plate is movable along said longitudinal axis.

* * * * *